US006146745A

United States Patent [19]

Altonen et al.

[11] Patent Number: 6,146,745

[45] **Date of Patent: *Nov. 14, 2000**

[54] OPEN CELL MESH AND METHOD FOR CHARACTERIZING A MESH

[75] Inventors: Gene M. Altonen, West Chester; Richard M. Girardot, Cincinnati; Lyle B. Tuthill, Indian Hill, all of Ohio

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/672,126

[22] Filed: Jun. 27, 1996

Related U.S. Application Data

[63] Continuation-in-part of application No. 08/631,860, Apr. 12, 1996, abandoned.

[51] Int. Cl.[7] ..... B32B 3/12

[52] U.S. Cl. ..... 428/219; 442/1; 442/50; 442/41; 15/209.1; 15/208

[58] Field of Search ..... 442/1, 41, 50; 428/131, 136, 219; 15/208, 209.1

[56] References Cited

U.S. PATENT DOCUMENTS

| | | | |
|---|---|---|---|
| 1,533,868 | 4/1925 | Kingman | 15/229.1 |
| 1,659,977 | 2/1928 | Kingman | 15/208 |
| 1,689,207 | 10/1928 | Kingman | 15/229.1 |
| 1,794,854 | 3/1931 | Kean | 15/229.1 |
| 1,865,785 | 7/1932 | Parker | 15/209.1 |
| 1,963,529 | 6/1934 | Protz | 15/208 |
| 2,006,708 | 7/1935 | Benedict | 15/208 |
| 2,151,448 | 3/1939 | Steinberg | 2/158 |
| 2,601,771 | 7/1952 | Cameron | 66/170 |
| 2,857,610 | 10/1958 | Rympalski | 15/209 |
| 2,940,100 | 6/1960 | Grossmeyer | 15/118 |
| 3,169,264 | 2/1965 | Walker | 15/118 |
| 3,241,171 | 3/1966 | Benjamin et al. | 15/118 |
| 3,711,889 | 1/1973 | Jennings | 15/227 |
| 3,772,728 | 11/1973 | Johnson | 15/209 R |
| 3,778,172 | 12/1973 | Myren | 401/7 |
| 3,917,889 | 11/1975 | Gaffney et al. | 428/36 |
| 3,952,127 | 4/1976 | Orr | 428/255 |
| 3,957,565 | 5/1976 | Livingston et al. | 156/244 |
| 3,977,452 | 8/1976 | Wright | 150/3 |
| 4,017,949 | 4/1977 | Botvin | 28/77 |
| 4,020,208 | 4/1977 | Mercer et al. | 428/255 |
| 4,040,139 | 8/1977 | Botvin | 15/209 B |
| 4,052,238 | 10/1977 | Botvin | 156/148 |
| 4,057,449 | 11/1977 | Livingston et al. | 156/167 |
| 4,059,713 | 11/1977 | Mercer | 428/36 |
| 4,123,491 | 10/1978 | Larsen | 264/167 |
| 4,144,612 | 3/1979 | Yamaguchi | 15/208 |
| 4,152,479 | 5/1979 | Larsen | 428/224 |
| 4,154,542 | 5/1979 | Rasmason | 401/7 |
| 4,168,863 | 9/1979 | Hatcher | 300/21 |
| 4,196,490 | 4/1980 | Jonzon | 15/222 |
| 4,206,948 | 6/1980 | Shimizu | 300/21 |
| 4,287,633 | 9/1981 | Gropper | 15/209 B |

(List continued on next page.)

FOREIGN PATENT DOCUMENTS

| | | | |
|---|---|---|---|
| 60-264235 | 12/1985 | Japan . | |
| 1308904 | 7/1973 | United Kingdom . | |
| 1473147 | 9/1974 | United Kingdom | A47K 07/30 |
| 2237196 | 5/1991 | United Kingdom . | |

*Primary Examiner*—Elizabeth M. Cole
*Attorney, Agent, or Firm*—Leonard W. Lewis; Jack L. Oney, Jr.

[57] ABSTRACT

Disclosed is an improved open cell mesh which exhibits superior softness, while also retaining acceptable resiliency, as a result of controlling cell structure parameters. In preferred embodiments, physically measurable parameters of the open cell mesh, and more particularly the cell structure, are controlled within pre-defined ranges. The controlled physical parameters of the subject open cell mesh include basis weight, cell count, node count, node length, node thickness, and node width. Additionally, there is provided a method of testing the mesh's resistance to an applied load, which is a predictive indicator of softness and resiliency.

8 Claims, 4 Drawing Sheets

U.S. PATENT DOCUMENTS

| | | | |
|---|---|---|---|
| 4,343,061 | 8/1982 | Hanazono | 15/244 B |
| 4,457,640 | 7/1984 | Anderson | 401/7 |
| 4,462,135 | 7/1984 | Sanford | 15/105 |
| 4,473,611 | 9/1984 | Haq | 428/198 |
| 4,651,505 | 3/1987 | Gropper | 53/456 |
| 4,710,185 | 12/1987 | Sneyd, Jr. et al. | 604/372 |
| 4,732,723 | 3/1988 | Madsen et al. | 264/147 |
| 4,769,022 | 9/1988 | Chang et al. | 604/368 |
| 4,893,371 | 1/1990 | Hartmann | 15/209 B |
| 4,911,872 | 3/1990 | Hureau et al. | 264/146 |
| 4,948,585 | 8/1990 | Schlein | 424/40 |
| 4,969,226 | 11/1990 | Seville | 15/244.4 |
| 4,986,681 | 1/1991 | Oliver | 401/7 |
| 4,993,099 | 2/1991 | Emura et al. | 15/118 |
| 5,144,744 | 9/1992 | Campagnoli | 29/446 |
| 5,187,830 | 2/1993 | Giallourakis | 15/244.3 |
| 5,229,181 | 7/1993 | Daiber et al. | 428/58 |
| 5,295,280 | 3/1994 | Hudson et al. | 15/222 |
| 5,412,830 | 5/1995 | Girardot et al. | 15/118 |
| 5,465,452 | 11/1995 | Girardot et al. | 15/210.1 |
| 5,491,864 | 2/1996 | Tuthill et al. | 15/118 |

OPEN CELL MESH AND METHOD FOR CHARACTERIZING A MESH

This is a continuation-in-part of application Ser. No. 08/631,860, filed on Apr. 12, 1996 now abandoned.

TECHNICAL FIELD

This invention relates generally to an improved extruded open cell mesh. More particularly, this invention relates to an improved open cell mesh which exhibits superior softness while retaining acceptable resiliency, and a method of objectively characterizing the physical parameters of a mesh. Optimization of softness and resiliency is accomplished through control of a variety of physical features of the extruded open cell mesh.

BACKGROUND OF THE INVENTION

The production of extruded open cell mesh is known to the art. Plastic mesh has been used for a variety of purposes, such as mesh bags for fruits and vegetables. Open cell mesh provides a lightweight and strong material for containing relatively heavy objects, while providing the consumer with a relatively unobstructed view of the material contained within the mesh. Such mesh can also be used to make personal cleansing implements.

Prior open cell mesh used to manufacture washing implements has typically been manufactured in tubes through the use of counter-rotating extrusion dies which produce diamond-shaped cells. The extruded tube of mesh is then typically stretched to form hexagonal-shaped cells. The description of a general hexagonal-shaped mesh can be found in U.S. Pat. No. 4,020,208 to Mercer, et al. An example of a counter-rotating die and an extrusion mechanism is described in U.S. Pat. No. 3,957,565 to Livingston, et al. Likewise, square or rectangular webbing has been formed in sheets by two flat reciprocating dies, as shown in U.S. Pat. No. 4,152,479 to Larsen. Although the aforementioned references describe open cell meshes and methods for producing open cell meshes, these references do not describe a soft, resilient product which can be used, for example, as a washing implement. Nor do any of the references listed above define a method of characterizing the softness and resilience of a mesh.

Recently, open cell meshes have been adapted for use as implements for scrubbing, bathing or the like, due to the relative durability and inherent scrubbing characteristics of the mesh. Also, open cell meshes improve lather of soaps in general, and more particularly, the lather of liquid soap is improved significantly when used with an implement made from an open cell mesh. Cleansing ability is generally due to the stiffness of the multiple filaments and nodes of the open cell mesh, causing a friction effect or sensation. To make a scrubbing or bathing implement, the extruded open cell mesh is shaped and bound into one of a variety of final shapes, e.g., a ball, tube, pad or other shape which may be ergonomically friendly to the user of the washing implement. The open cell meshes of the past were acceptable for scrubbing due to the relative stiffness of the fibers and the relatively rough texture of the nodes which bond the fibers together. However, that same stiffness and roughness of prior art mesh was relatively harsh when applied to human skin.

The references described above have been concerned primarily with the strength and durability of the open cell mesh for either containing relatively heavy objects, e.g., fruit and vegetables, or for vigorous scrubbing and cleaning, e.g., of pots and pans. In order to meet the strength and durability requirements, extruded open cell meshes of the past have been manufactured from relatively stiff fibers joined together at nodes whose physical size and shape tended to make them stiff and scratchy, as opposed to soft and conformable.

Hence, heretofore, there has been a continuing need for an improved extruded open cell mesh which would be soft, durable, relatively inexpensive to manufacture, and relatively resilient without being overly stiff and scratchy. More specifically, there was a need for providing an improved open cell mesh, featuring physical characteristics which could be adequately identified and characterized, so that mesh could be reliably made, while exhibiting all of the aforementioned desired physical properties.

SUMMARY OF THE INVENTION

It is an object of the present invention to provide an improved open cell mesh which overcomes the problems described above. It is a further object of the present invention to provide a soft, yet resilient, extruded open cell mesh which is durable enough for use as a scrubbing or bathing implement. It is a related object of the present invention to provide a scrubbing or bathing implement which improves lather when used with soap. It is yet another object of the present invention to provide a method of characterizing an open cell extruded mesh based on its physical parameters and measurable performance tests, so that the improved open cell mesh is easily manufactured and easily recreated as desired.

There is provided herein an extruded open cell mesh comprising a series of extruded filaments which are periodically bonded together to form repeating cells. The bonded areas between filaments are designated as "nodes", while a "cell" is defined by a plurality of filament segments with one node at each of its corners. The extruded cells of preferred embodiments are typically square, rectangular, or diamond shaped, at the time of extrusion, but the extruded mesh is often thereafter stretched to elongate the nodes, filaments, or both, to produce the desired cell geometry and strength characteristics of the resulting mesh. The mesh can be produced through a counter-rotating extrusion die, two reciprocating flat dies, or by other known mesh forming procedures. Tubes of mesh, such as can be produced by counter-rotating extrusion dies, have a preferred node count of between about 70 and about 140, with an especially preferred range of between about 95 and about 115. The node count is measured circumferentially around the mesh tube. A preferred cell count of a tube or sheet of mesh is between about 130 and about 260 cells/meter, with an especially preferred range of between about 170 and about 250 cells/meter. Cell count is measured by a standardized test described herein.

The extruded open cell mesh can be characterized as having an Initial Stretch value, which can be obtained through the use of a standardized test method described herein. A preferred basis weight for mesh of the present invention to be utilized for washing implements is from about 5.60 grams/meter to about 10.50 grams/meter, and an especially preferred basis weight would be from about 6.00 grams/meter to about 8.85 grams/meter. Preferred Initial Stretch values are from about 7.0 inches to about 20.0 inches. More preferred Initial Stretch values are from about 9.0 inches to about 18.0 inches. Most preferred Initial Stretch values are from about 10.0 inches to about 16.0 inches.

In yet another preferred embodiment of the present invention, the extruded open cell mesh is made from low-density polyethylene having a Melt Index of between about 1.0 and about 10.0. The preferred Melt Index for low-density polyethylene is between about 2.0 and about 7.0. Preferred nodes of the present invention have an approximate length, measured from opposing Y-crotches, of from about 0.051 cm to about 0.200 cm. Preferred nodes have a thickness ranging from about 0.020 cm to about 0.038 cm, and a width ranging from about 0.038 cm to about 0.102 cm.

BRIEF DESCRIPTION OF THE DRAWINGS

While the specification concludes with claims particularly pointing out and distinctly claiming the present invention, it is believed the same will better be understood from the following description taken in conjunction with the accompanying drawings in which:

DETAILED DESCRIPTION OF THE PREFERRED EMBODIMENTS

Reference will now be made in detail to the present preferred embodiments of an improved open cell mesh and preferred methods for characterizing open cell mesh, examples of which are illustrated in the accompanying drawings.

The process of manufacturing diamond cell and hexagonal cell mesh for use in washing implements and the like, involves the selection of an appropriate resin material which can include polyolefins, polyamides, polyesters, and other appropriate materials which produce a durable and functional mesh. Low density polyethylene (LDPE, a polyolefin), poly vinyl ethyl acetate, high density polyethylene, or mixtures thereof, are preferred to produce the mesh described herein, although other resin materials can be substituted provided that the resulting mesh conforms with the physical parameters defined below. Additionally, adjunct materials are commonly added to extruded mesh. Mixtures of pigments, dyes, brighteners, heavy waxes and the like are common additives to extruded mesh and are appropriate for addition to the mesh described herein.

To produce an improved open cell mesh, the selected resin is fed into an extruder by any appropriate means. Extruder and screw feed equipment for production of synthetic webs and open cell meshes are known and available in the industry.

After the resin is introduced into the extruder it is melted so that it flows through extrusion channels and into the counter-rotating die, as will be discussed in greater detail below. Resin melt temperatures will vary depending upon the resin selected. The material's Melt Index is a standard parameter for correlating extrusion die temperatures to the viscosity of the extruded plastic as it flows through the die. Melt Index is defined as the viscosity of a thermoplastic polymer at a specified temperature and pressure; it is a function of the molecular weight. Specifically, Melt Index is the number of grams of such a polymer that can be forced through a 0.0825 inch orifice in 10 minutes at 190 degrees C by a pressure of 2160 grams.

A Melt Index of from about 1.0 to about 10.0 for LDPE is preferred for manufacturing the mesh described herein, and a Melt Index of from about 2.0 to about 7.0 is especially preferred. However, if alternate resin materials are used and/or other ultimate uses for the mesh are desired, the Melt Index might be varied, as appropriate. The temperature range of operation of the extruder can vary significantly between the melt point of the resin and the temperature at which the resin degrades.

Figure 1:
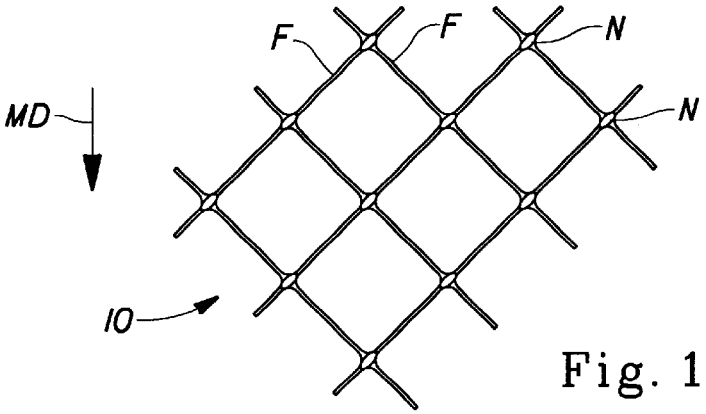
FIG. 1 illustrates an exemplary section of mesh after extrusion.

The liquified resin can then be extruded through two counter-rotating dies, which are common to the industry. U.S. Pat. No. 3,957,565 to Livingston, et. al., for example, describes a process for extruding a tubular plastic netting using counter-rotating dies, such disclosure hereby incorporated herein by reference. A counter-rotating die has an inner and outer die, and both have channels cut longitudinally around their outer and inner circumferences respectively, such that when resin flows through the channels, fibers are extruded. Individual fibers, e.g., F, as seen in FIG. 1, are extruded from each channel of the inner die as well as each channel of the outer die to form mesh section 10. As the two dies are rotated in opposite directions relative to one another, the channels from the outer die align with the channels of the inner die, at predetermined intervals. The liquefied resin is thereby mixed as two channels align, and the two fibers (e.g., F, as seen in FIG. 1) being extruded are bonded together until the extrusion channels of the outer and inner die are misaligned due to continued rotation. As the inner die and outer die rotate counter-directionally to each other, the process of successive alignment and misalignment of the channels of each die occurs repeatedly. The point at which the channels align and two fibers are bonded together is commonly referred to as a "node" (e.g., N of FIG. 1).

The "die diameter" is measured as the inner diameter of the outer die or the outer diameter of the inner die. These two diameters must be essentially equal to avoid stray resin from leaking between the two dies. The die diameter affects the final diameter of the tube of mesh being produced, although die diameter is only one parameter which controls the final diameter of the mesh tube. Although it is believed that a wide variety of die diameters, for example between about 2 inches and about 6 inches, are suitable for manufacturing the meshes described herein, especially preferred die diameters are in the range of between about 2½ and about 3½ inches (about 6.35 and about 8.89 centimeters).

The extrusion channels can likewise be varied among a variety of geometric configurations known to the art. Square, rectangular, D-shaped, quarter-moon, semicircular, keyhole, and triangular channels are all shapes known to the art, and can be adapted to produce the mesh described herein. Quarter-moon channels are preferred for the mesh of the present invention, although other channels also provide acceptable results.

After the tube of mesh is extruded from the counter-rotating dies, it can be characterized as having diamond-shaped cells (FIG. 1) where each of the four corners of the diamond is an individual node N and the four sides of the diamond are four, separately formed filament segments F. The tube is then pulled over a cylindrical mandrel where the longitudinal axis of the mandrel is essentially parallel to the longitudinal axis of the counter-rotating dies, i.e., the machine direction (MD as shown in FIG. 1). The mandrel serves to stretch the web circumferentially resulting in stretching the nodes and expanding the cells. Typically the mandrel is immersed in a vat of water, oil or other quench solution, which is typically 25 degrees C or less, which serves to cool and solidify the extruded mesh.

The mandrel can be a variety of diameters, although it will be chosen to correspond appropriately to the extrusion die diameter. The mandrel is preferably larger in diameter than the die diameter to achieve a desired stretching effect, but the mandrel must also be small enough in diameter to avoid damaging the integrity of the mesh through over-stretching. Mandrels used in conjunction with the preferred 2.5"–3.5" die diameters mentioned above might be between about 3.0" and about 6.0" (about 7.62 cm and about 15.24 cm). Mandrel diameter has an ultimate effect on the Initial Stretch value described in greater detail below.

Figure 2:
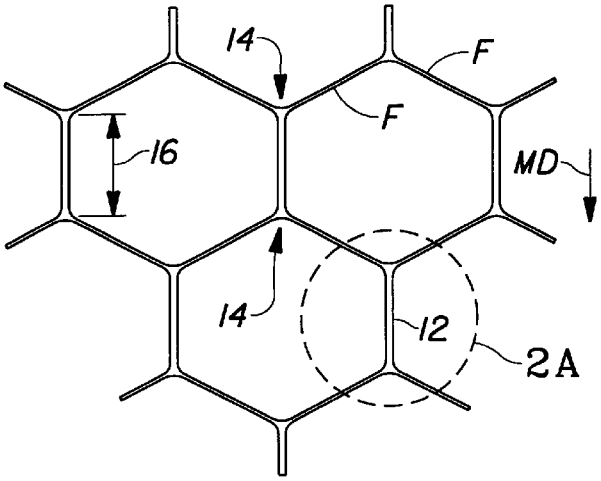
FIG. 2 illustrates an exemplary extruded section of mesh after stretching.
Figure 2A:
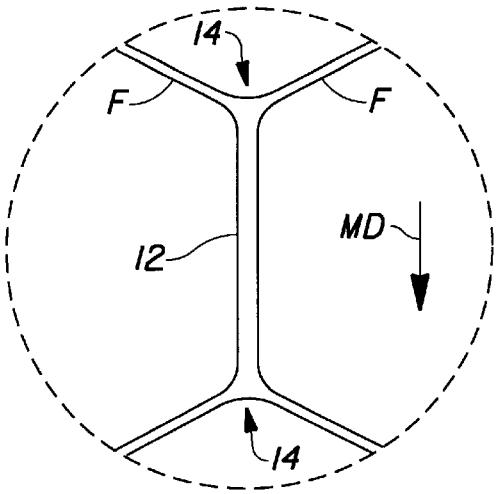
FIG. 2A illustrates an enlarged exemplary view of a node after stretching.

As the nodes of the diamond cell mesh are stretched, they are transformed from small, ball-like objects (e.g., FIG. 1) to longer, thinner filament-like nodes (e.g., N of FIGS. 2 and 2A). The cells are thereby also transformed from a diamond-like shape to hexagonal-shape wherein the nodes form two sides of the hexagon, and the four individual filament segments F form the other four sides of the hexagon. The geometric configuration of the mesh cells can also vary significantly depending on how the tube of mesh is viewed. Thus, the geometric cell descriptions are not meant to be limiting but are included for illustrative purposes only.

After passing over the mandrel, the tube is then stretched longitudinally over a rotating cylinder whose longitudinal axis is essentially perpendicular to the longitudinal axis of the tube; i.e. the longitudinal axis of the rotating cylinder is perpendicular to the machine direction (MD) of the mesh. The mesh tube is then pulled through a series of additional rotating cylinders whose longitudinal axes are perpendicular to the longitudinal axis, or the machine direction (MD) of the extruded mesh.

Preferably the mesh is taken-up faster than it is produced, which supplies the desired longitudinal, or machine direction, stretching force. Typically a take-up spool is used to accumulate the finished mesh product. As should be apparent, there are a variety of process parameters (e.g., resin feed rate, die diameter, channel design, die rotation speed, and the like) that affect mesh parameters such as node count, basis weight and cell count.

Although the production of open cell mesh in a tube configuration through the use of counter-rotating dies, as described, is preferred for the embodiments of the present invention, alternative processing means are known to the art. For example, U.S. Pat. No. 4,123,491 to Larsen (the disclosure of which is hereby incorporated herein by reference), shows the production of a sheet of open cell mesh wherein the filaments produced are essentially perpendicular to one another, forming essentially rectangular cells. The resulting mesh net is preferably stretched in two directions after production, as was the case with the production of tubular mesh described above.

Yet another alternative for manufacturing extruded open cell mesh is described in U.S. Pat. No. 3,917,889 to Gaffney, et al., the disclosure of which is hereby incorporated herein by reference. The Gaffney, et al. reference describes the production of a tubular extruded mesh, wherein the filaments extruded in the machine direction are essentially perpendicular to filaments or bands of plastic material which are periodically formed transverse to the machine direction. The material extruded transverse to the machine direction can be controlled such that thin filaments or thick bands of material are formed. As was the case with the mesh manufacturing procedures described above, the tubular mesh manufactured according to the Gaffney, et al. reference is preferably stretched both circumferentially and longitudinally after extrusion.

Figure 6:
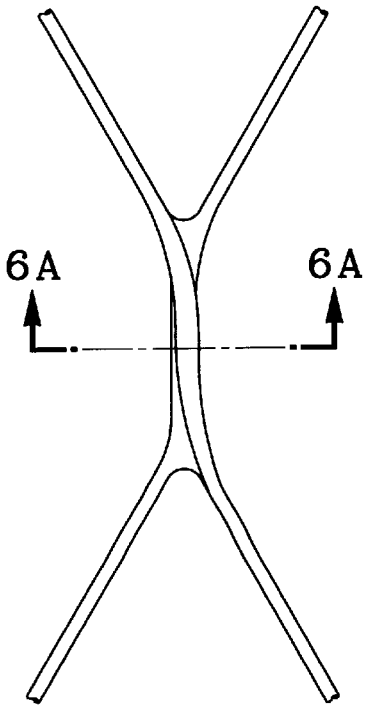
FIG. 6 illustrates an overlaid node in open cell mesh.
Figure 6A:
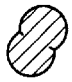
FIG. 6A illustrates a cross section of the node of FIG. 6.

A key parameter when selecting a manufacturing process for the improved mesh described herein is the type of node produced. As was described above, a node is the bonded intersection between filaments. Typical prior art mesh is made with overlaid nodes (FIGS. 6 and 6A). An overlaid node can be characterized in that the filaments which join together to form the node are still distinguishable, although bonded together at the point of interface. In an overlaid node, the filaments at both ends of the node form a Y-crotch, although the filaments are still distinguishable at the interface of the node. Overlaid nodes result in a mesh which has a scratchy feel.

Figure 5:
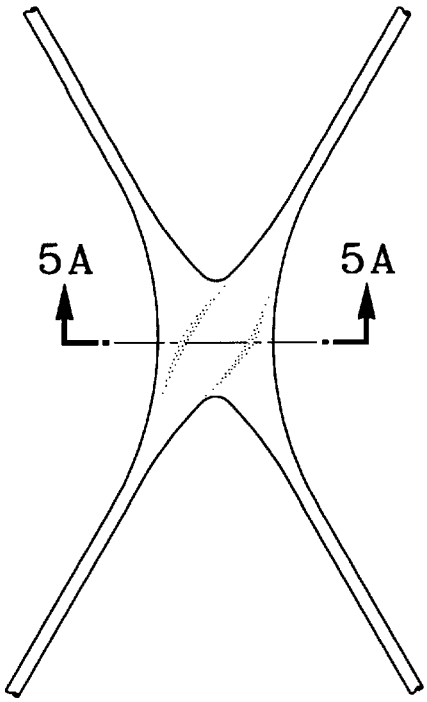
FIG. 5 illustrates a merged node in open cell mesh.
Figure 5A:
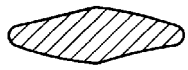
FIG. 5A illustrates a cross section of the node of FIG. 5.

A merged node (FIGS. 5 and 5A) can be characterized by the inability after production of the mesh to easily visually distinguish the filament sections which form the node. Typically, a merged node resembles a wide filament segment. A merged node can have a "ball-like" appearance, similar to that shown by N of FIG. 1, or can be stretched subsequent to formation to have the appearance of node 12 of FIGS. 2 and 2A. In either case, at each end of the node there is a Y-crotch configuration, e.g., 14 of FIGS. 2 and 2A, at the point where the filament segments F branch off the node. For both overlaid and merged nodes, node length 16 of FIG. 2, is defined as the distance from the center of the crotch of one Y-shape to the center of the crotch of the Y-shape at the opposite end of the node. The combination of merged nodes with specific physical characteristics described herein results in a mesh with a consumer preferred range of softness and resiliency, specifically when used in cleansing implements.

As should be apparent, the measurements of node length, node width, and node thickness are to be assessed at the conclusion of the manufacturing process, (i.e., after the material has been through the stretching steps). Preferred nodes of mesh have an approximate length, measured from opposing crotches, of from about 0.051 cm to about 0.200 cm, the nodes have a "thickness" ranging from about 0.020 centimeters to about 0.038 centimeters, and a "width" of from about 0.038 cm to about 0.102 cm.

Figure 3:
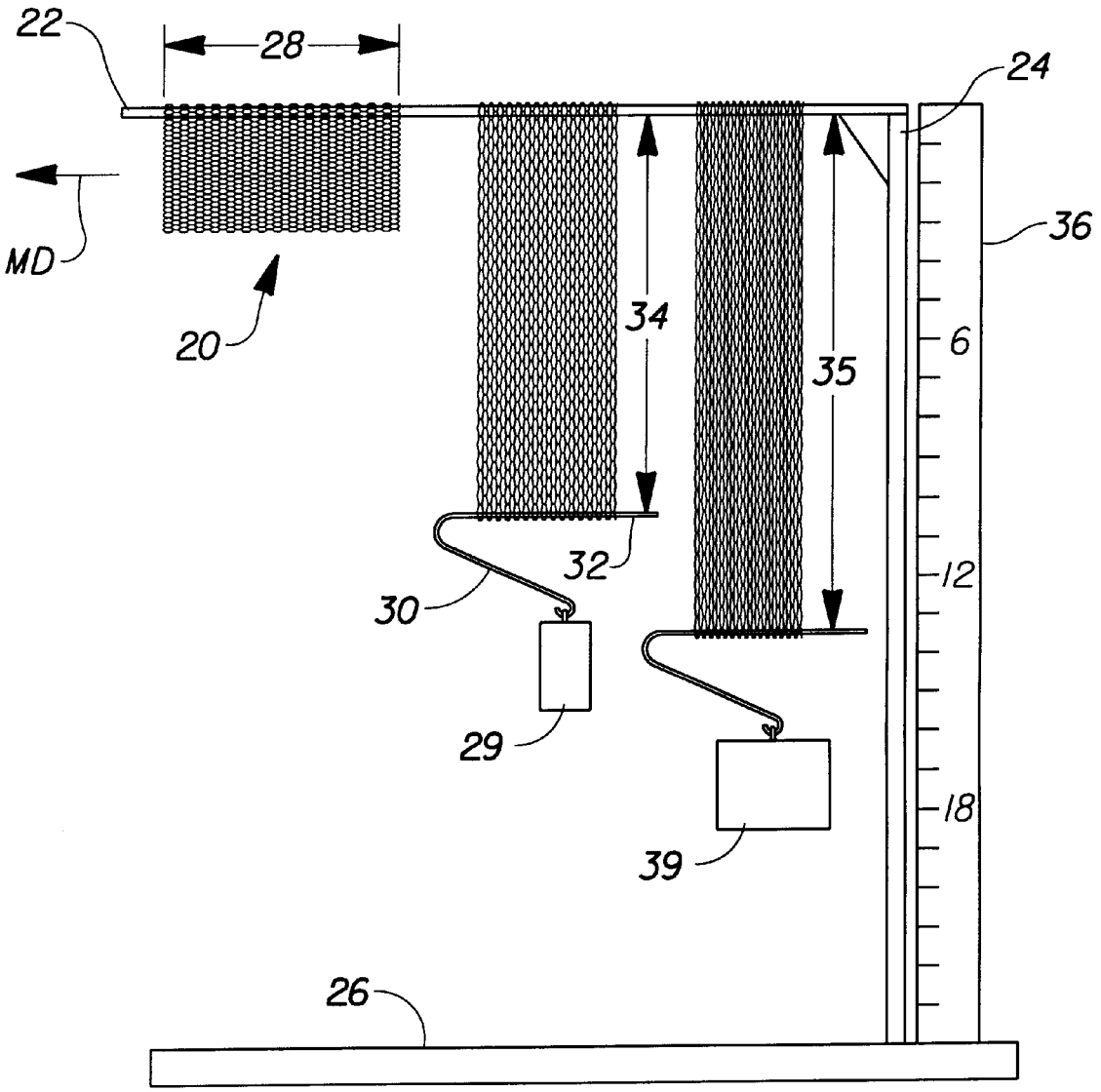
FIG. 3 is a schematic illustration of testing procedures for measuring an open cell mesh's resistance to an applied weight, which is useful in characterizing the open cell mesh made according to the subject invention.

As will be apparent, the measurement of flexibility of a mesh is a critical characterization of the softness and conformability of a mesh. It has been determined that a standardized test of mesh flexibility can be performed as described herein and as depicted in FIG. 3. The resulting measurement of flexibility is defined herein as Initial Stretch. As schematically illustrated in FIG. 3, the procedure for determining Initial Stretch begins by hanging a mesh tube 20 from a test stand horizontal arm 22, which in turn is supported by a vertical support member 24 and which is in turn attached to a test stand base 26.

As was described above, when the open cell mesh is extruded from a counter-rotating die, the mesh is formed in a tube. If a sheet of mesh is produced, as was described in the Larsen '491 patent, the sheet must be formed into a tube by binding the sheet's edges securely together prior to performing the Initial Stretch measurement. The tube of mesh 20 for testing should be 6.0 inches (15.24 cm) in length, as indicated by length 28. Six inches was chosen, along with a 50.0 gram weight, as an arbitrary standard for making the measurement. As will be apparent, other standard conditions could have been chosen, however, in order to compare Initial Stretch values for different meshes, it is preferred that the standard conditions chosen and described herein are followed uniformly.

As is illustrated in FIG. 3, a standardized weight, is suspended from a weight support member 30, which has a weight support horizontal arm 32 placed through and hung from the mesh tube 20. It is critical that the total combined weight of the support member 30 and the standardized weight together equal 50 grams. Distance 34 illustrates the Initial Stretch, and is the distance which mesh tube 20 stretches immediately after the weight has been suspended from it. A linear scale 36 is preferably used to measure distance 34. For mesh of the present invention it is generally preferred to have an Initial Stretch value of from about 7.0 inches (17.8 cm) to about 20.0 inches (50.8 cm), more preferred to have a Initial Stretch value of from about 9.0 inches (22.9 cm) to about 18.0 inches (45.7 cm), and most preferred to have an Initial Stretch value of from about 10.0 inches (25.4 cm) to about 16.0 inches (40.6 cm).

The resilient property of the open cell mesh can be measured by suspending a larger standardized weight (i.e., 250 grams, as shown in FIG. 3) from the mesh sample 20, and substracting the distance 34 from the distance 35. It is critical that the total combined weight of the support member plus the larger standardized weight equal 250 grams. The result is directly proportional to the resilience level of the mesh.

Figure 4:
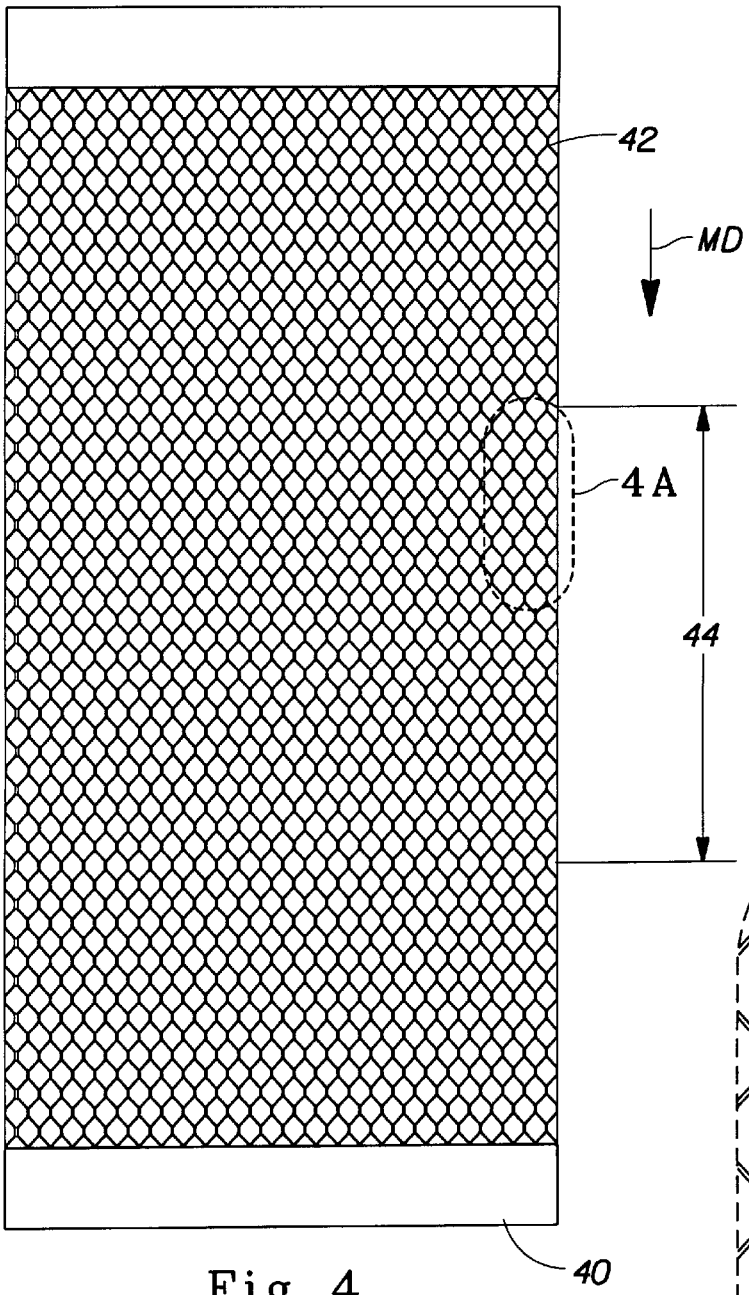
FIG. 4 illustrates a method of the present invention for counting cells in an open cell mesh.

FIG. 4 illustrates a standardized method for counting cells. The mesh 42 is a section of mesh greater than twelve inches in length. The mesh section 42 is pulled taught along its machine direction, MD. When the mesh is taught, a twelve inch (30.48 cm) segment 44 is marked, for example with a felt tipped marker.

Figure 4A:
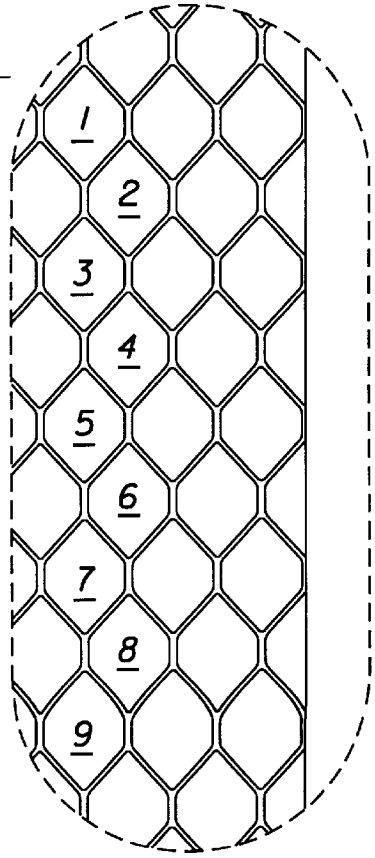
FIG. 4A illustrates an expanded view of the mesh of FIG. 4.

After the mesh section 44 is marked, the mesh section may be stretched transverse to the machine direction to expose the individual cells so that the cells within the mesh segment 44 can be easily counted. A rigid frame 40 may be used to secure a section of mesh 42 so that the segment of mesh being counted 44 is held in place. FIG. 4A illustrates an enlarged portion of the mesh, with numbers 1 through 9 indicating individually counted cells. As can be seen in the enlarged portion, one cell in each row within the marked off section of mesh is counted longitudinally in order to yield the cells per unit length (in FIG. 4 the value would be about 28.5 cells per foot). For the purpose of standardization, a 12.0 inch section of mesh (30.48 cm) is counted to arrive at the number of cells per foot. As will be apparent, counting a shorter or longer segment of mesh is acceptable, the only qualification being that the cell count is ultimately converted to cells/meter.

Characterizing the improved mesh in the direction (T) transverse to the longitudinal axis is accomplished by counting nodes. This method is universal to tubes or flat sheets of mesh and simply comprises selecting a row of nodes and counting them across one row of the sheet or across one circumference of the tube. As should be apparent, the number of nodes in each row of cells will be identical because this is dependent upon extrusion die configuration; every other row of nodes will be shifted half of one cell width (longitudinally). A preferred range for node count for mesh of the subject invention is between about 70 and about 140. An especially preferred range is between about 95 and about 115.

Basis weight is another empirical measurement which can be performed on any tube or sheet of extruded open cell mesh. A length of mesh is measured along the machine direction (MD), then cut transverse to the machine direction, with this measured and cut section then being weighed. The basis weight is preferably tracked in units of grams per meter. For purposes of standardization, a 12.0 inch section of mesh (30.48 cm) is measured, cut and weighed, and the results converted to and reported in grams per meter. The preferred basis weight for mesh of the subject invention is from about 5.60 grams/meter to about 10.50 grams/meter, with an especially preferred range of from about 6.00 grams/meter to about 8.85 grams/meter. The preferred meshes of the present invention can be characterized by a compilation of the aforementioned measurable parameters. As should be apparent, the processing parameters described above can be varied individually or in combination to produce the desired physical properties described herein.

Through the course of experimentation we have discovered that netting materials that are highly flexible under a very low level of stress are perceived by consumers as having a much softer feel on the skin. Further, when this highly flexible netting is formed into a bathing implement, the resulting implement significantly improves consumer ratings for both the cleansing implement as well as the cleaning product it is used with.

We hypothesize that the improved consumer ratings are directly attributable to the more flexible netting materials ability to conform easily to body contours, and to more evenly distribute applied forces thus reducing abrasion. The result is an improved consumer perception of "softness", and not being "scratchy".

Low stress flexibility is quantified by talking a 6 inch sample of netting & measuring the distance it is deformed/stretched under a fixed 50 gram load. This is referred to as a materials Initial Stretch. We have found that for a fixed set of netting parameters (e.g. basis weight & cell size) the greater the magnitude of Initial Stretch the higher the consumer perception of softness.

The benefits of the improved mesh of this invention when used as a washing implement or the like, include improved consumer acceptability and improved softness when the washing implement is rubbed against human skin. Improved lathering is also an important quality of bathing implements made from mesh of the present invention. Lather is improved when the soap is in bar, liquid, and most importantly, gel form. When mesh is used in the production of washing implements, tactile softness, i.e., the feel of the mesh as it contacts human skin is an important criteria. However, resiliency is also an important physical criteria. It is generally intuitive that producing a softer mesh may result in a relatively limp mesh which may not retain the desired shape for the washing implement, i.e., stiffness is sacrificed in favor of softness. However, mesh of the present invention has been found to have the unique properties of being both soft and relatively resilient, i.e. the mesh is able to retain its shape when used as a washing implement. A washing implement which is soft but does not resiliently conform to the skin or object being scrubbed (i.e., the implement is limp), is generally not acceptable to consumers. Therefore, the improved open cell mesh described herein provides a material which is both soft to the touch and, when used to manufacture washing implements, is resilient enough to provide the necessary conformability and resiliency which is preferred by consumers.

Having showed and described the preferred embodiments of the present invention, further adaptation of the improved open cell mesh can be accomplished by appropriate modifications by one of ordinary skill in the art without departing from the scope of the present invention. A number of alternatives and modifications have been described herein, and others will be apparent to those skilled in the art. For example, broad ranges for the physically measurable parameters have been disclosed for the inventive open cell mesh as preferred embodiments of the present invention, yet within certain limits, the physical parameters of the open cell mesh can be varied to produce other preferred embodiments of improved mesh of the present invention as desired. Accordingly, the scope of the present invention should be considered in terms of the following claims and is understood not be limited to the details of the structures and methods shown and described in the specification and in the drawings.

We claim:

1. An extruded open cell mesh comprising:

a basis weight, a plurality of nodes, and a plurality of cells, the mesh having properties comprising;

a) a node count ranging from about 70 to about 140;

b) a node length ranging from about 0.051 centimeters to about 0.200 centimeters;

c) a node width ranging from about 0.038 centimeters to about 0.102 centimeters;

d) a node thickness ranging from about 0.020 centimeters to about 0.038 centimeters;

e) a cell count ranging from about 130 cells per meter to about 260 cells per meter; and f) a basis weight ranging from about 5.60 grams per meter to about 10.50 grams per meter.

2. The mesh according to claim 1, wherein the mesh comprises low density polyethylene, poly vinyl ethyl acetate, high density polyethylene, ethylene vinyl acetate, or mixtures thereof.

3. The mesh according to claim 1, wherein the mesh is low density polyethylene having a Melt Index of between about 1.0 gms/10 mins. and about 10.0 gms/10 mins.

4. The mesh according to claim 3, wherein the low density polyethylene has a Melt Index of between about 2.0 gms/10 mins. and about 7.0 gms/10 mins.

5. An extruded open cell mesh comprising:

a basis weight, a plurality of merged nodes, and a plurality of cells, the mesh having properties comprising;

a) a node count ranging from about 95 to about 115;

b) a node length ranging from about 0.051 centimeters to about 0.200 centimeters;

c) a node width ranging from about 0.038 centimeters to about 0.102 centimeters;

d) a node thickness ranging from about 0.020 centimeters to about 0.038 centimeters;

e) a cell count ranging from about 170 cells per meter to about 250 cells per meter; and f) a basis weight ranging from about 6.00 grams per meter to about 8.85 grams per meter.

6. The mesh according to claim 5, wherein the mesh comprises low density polyethylene, poly vinyl ethyl acetate, high density polyethylene, ethylene vinyl acetate, or mixtures thereof.

7. The mesh according to claim 5, wherein the mesh is low density polyethylene having a Melt Index of between about 1.0 gms/10 mins. and about 10.0 gms/10 mins.

8. The mesh according to claim 7, wherein the low density polyethylene having a Melt Index of between about 2.0 gms/10 mins. and about 7.0 gms/10 mins.

* * * * *